US005629676A

United States Patent [19]

Kartoun et al.

[11] Patent Number: 5,629,676

[45] Date of Patent: May 13, 1997

[54] ALARM SYSTEM

[75] Inventors: David Kartoun, Ramat Hasharon; Vyacheslav Kofman, Holon, both of Israel

[73] Assignee: Rokonet Electronics, Limited, Rishon LeZion, Israel

[21] Appl. No.: 365,076

[22] Filed: Dec. 28, 1994

[30] Foreign Application Priority Data

Jul. 25, 1994 [IL] Israel ..... 110429

[51] Int. Cl.[6] ..... G08B 13/18

[52] U.S. Cl. ..... 340/567; 250/DIG. 1; 340/511; 374/133

[58] Field of Search ..... 340/567, 587, 340/511; 250/342, 339.14, DIG. 1; 374/133

[56] References Cited

U.S. PATENT DOCUMENTS

| | | | |
|---|---|---|---|
| 3,781,837 | 12/1973 | Anderson et al. | 340/587 X |
| 4,005,605 | 2/1977 | Michael | 374/133 X |
| 4,195,234 | 3/1980 | Berman | 340/567 X |
| 4,895,164 | 1/1990 | Wood | 374/124 X |
| 4,943,712 | 7/1990 | Wilder | 340/567 X |
| 5,448,224 | 9/1995 | Mochizuki | 340/587 X |

FOREIGN PATENT DOCUMENTS

| | | | |
|---|---|---|---|
| 98402 | 1/1984 | European Pat. Off. | 374/133 |
| 22486 | 3/1978 | Japan | 374/133 |
| 129525 | 5/1990 | Japan | 340/567 |
| 156398 | 6/1990 | Japan | 340/587 |

*Primary Examiner*—Thomas Mullen

*Attorney, Agent, or Firm*—Wigman, Cohen, Leitner & Myers, P.C.

[57] ABSTRACT

A system for detecting intrusion into a protected area by virtue of a change in detected infrared energy from an ambient level, and for generating an alarm signal in response thereto includes a first assembly having a Passive Infra Red (PIR) sensing element for generating a contrast signal representative of deviation in detected infrared energy, a second assembly for generating an ambient temperature signal, an amplifier for amplifying the contrast signal, and a processor for generating a threshold as a function of the ambient temperature. The gain and threshold are defined to generate an "alarm trigger condition", and an alarm activator responds to the "alarm trigger condition" for activating an alarm signal.

18 Claims, 6 Drawing Sheets

PRIOR ART

ALARM SYSTEM

FIELD OF THE INVENTION

The present invention relates to the field of passive infrared intrusion detectors and more particularly to temperature compensation means therefor.

BACKGROUND OF THE INVENTION

The principle of employing infrared radiation to detect the movement of intruders is well-known. The prior art discloses many Passive Infrared Detector apparatuses (hereinafter "PIR") that receive infrared radiation (hereinafter "IR radiation") from a field of view to detect when intruder enters a protected area.

The functioning of PIR detectors is dependent upon a temperature differential between the intruder and the background. An intruder such as a person typically has a higher body temperature, e.g. 37° C., and than the background temperature, e.g. 20° C., thus the difference or contrast between the radiation emitted by the intruder and the ambient radiation (produced by background objects) can be sensed and an alarm triggered when the contrast signal exceeds a specified threshold. As the background and ambient temperatures are nearly typically equivalent, they will be considered for all practical purposes as equivalent and the insignificant difference between them will be neglected. It is accordingly to be understood that in the context of the description and the appended claims the term "ambient temperature" and "background temperature" are interchangeable.

For the range of temperature differences that normally exist between an intruder and background objects, the contrast signal is approximately proportional to the temperature difference between the intruder and background objects normally present in the protected area. In fact, the contrast signal complies with Stephan-Boltzman's law, as will be explained in greater detail below.

The sensitivity (also referred to as detection range) of these detectors is dependent to a large extent on the ambient temperature, i.e. the sensitivity, decreases as the aforementioned contrast level decreases (which, as a rule, occurs when the ambient temperature approaches the intruder body temperature), and hence an infrared detector may not be able to discern an intruder when the temperature thereof nearly matches the ambient temperature.

Environmental conditions where the ambient temperature nearly matches the temperature of the intruder are particularly prone to occur in hot equatorial climates and the like.

Thus, when the contrast level generated by the PIR detector is of relatively low intensity, it had been found advantageous to amplify it by a given amplification gain so as to obtain a sufficient amplitude which is then fed to the alarm circuit which, in turn, activates the "alarm signal" should the amplified contrast signal exceed a pre-determined threshold.

The prior art discloses apparatuses which compensate for the reduced IR detecting sensitivity under the aforementioned environmental conditions (hereinafter "non-discernable intrusion temperature conditions").

There also exist IR-detectors which incorporate an ambient temperature sensor, such as a thermistor or any other temperature sensor, which are adapted to amplify the contrast signal in accordance with the ambient temperature so as to obtain a uniform sensitivity or detection range.

Alternatively, the amplification gain may be held invariant and the threshold level which triggers the alarm may be modified in accordance with the ambient temperature so as to maintain the specified uniform sensitivity of detection. U.S. Pat. No. 4,195,234 discloses one such apparatus which delivers an alarm signal when the level of radiation detected changes from the ambient level to a threshold level. A temperature responsive circuit therein adjusts the threshold level so as to decrease the threshold as the ambient temperature increases, or in an alternative embodiment increases the amplification gain as the ambient temperature increases.

The alarm device disclosed in the specified U.S. Pat. No. 4,195,234 failed in attaining the desired uniform sensitivity in particular in the case where the ambient temperature surpasses the intruder temperature. More specifically, the temperature responsive circuit disclosed therein provides an ever increasing amplification gain (or in an alternative embodiment ever decreasing threshold level), as the ambient temperature increases. Bearing in mind that the contrast signal produced at the output of the PIR sensor inherently increases as the ambient temperature rises over the intruder temperature, it appears that the ever-increasing intrinsic sensitivity of the PIR sensor is, needlessly, further enhanced (owing to the ever-increasing amplification gain or ever-decreasing threshold level) in the case where the ambient temperature exceeds the intruder temperature. thereby increasing the probability for undesired spurious alarms (due to radio frequency interference (RFI), electrical transients and others).

Moreover, even in the complementary range, i.e., where the ambient temperature drops below the intruder body temperature, the device disclosed in the specified U.S. Pat. No. 4,195,234 fails in attaining true uniform detection range since the ambient temperature compensation means disclosed therein provides for essentially monotonically increasing amplification gain, whereas the contrast signal decreases as the ambient temperature approaches the intruder body temperature in compliance with the Stephan-Boltzman's Law, i.e. it decreases exponentially to the power of four.

SUMMARY AND OBJECTS OF THE INVENTION

It is a general object of the invention to provide a new and improved infrared intrusion alarm system which will substantially reduce or overcome the drawbacks associated with hitherto known PIR based alarm systems. In particular it is an object of the invention to provide an alarm system of the above character having temperature responsive means for obtaining essentially uniform detector sensitivity in environmental conditions where the ambient temperature surpasses intruder temperature, thereby reducing the likelihood of spurious alarms.

It should be noted that, whereas there are known various other factors which affect the sensitivity of detection, e.g. the velocity in which the intruder crosses the sensor's field of view, the present invention concerns primarily the following influencing factors: contrast signal, ambient temperature, amplification factor and threshold level. If desired, known per se means may be employed for controlling the sensitivity, responsive to factors other than those specified herein.

There is thus provided in accordance with the invention, a system for detecting intrusion into a protected area by virtue of a change in detected infrared energy from an ambient level, and generating an alarm signal in response thereto, comprising:

first means including a PIR sensing element for generating a contrast signal C(T) representative of a deviation in detected infrared energy from that corresponding to the ambient temperature, wherein $C_p(T)$, signifies the peak value of said contrast signal;

second means for generating an ambient temperature signal representative of the ambient temperature T;

amplifier means for amplifying the contrast signal by a gain G(T) which is a function of the ambient temperature, so as to generate an amplified contrast signal (C(T)*G(T)), wherein ($C_p$(T)*G(T)) signifies the peak value of said amplified contrast signal;

processor means coupled to said second means and amplifier means, which processor means are adapted to generate a threshold Th(T) which is a function of the ambient temperature; wherein said gain G(T) and threshold Th(T) are defined to generate "alarm trigger condition" in which the absolute value of the peak value of the amplified contrast signal ($C_p$(T)*G(T)) essentially exceeds the absolute value of said threshold Th(T), by substantially a constant value, over an ambient temperature range which extends between a first value below, and a second value above, an intruder temperature level; and alarm activation means in association with said processor means for activating an alarm signal when said alarm trigger condition is encountered.

As will be explained in greater detail below, by one embodiment, the amplification gain function is held invariant whereas the threshold level is modified.

By another embodiment, the threshold level is maintained invariant whereas the amplification gain function is modified and, by a further embodiment both the threshold level and the amplification gain function are modified so as to obtain the desired uniform detection range.

In preferred embodiments, the processing means are adapted to employ as the gain function the following expression:

$$\frac{1}{|\epsilon_T T_{TARGET}^4 - \epsilon_B T_{BACK}^4|} \quad (1)$$

where $T_{TARGET}$ is the absolute temperature of the target, $T_{BACK}$ is the absolute background temperature, $\epsilon_T$ is the Emissivity coefficient of the target and $\epsilon_B$ is the Emissivity coefficient of the background. It should be noted that for all practical purposes $\epsilon_T \approx \epsilon_B \approx 1$.

The invention further provides for a method for detecting intrusion into a protected area by virtue of a change in detected infrared energy from an ambient level and for generating an alarm signal in response thereto, comprising:

generating a contrast signal C(T) representative of a deviation in detected infrared energy from that corresponding to the ambient temperature wherein $C_p$(T), signifies the peak value of said contrast signal:

generating an ambient temperature signal representative of the ambient temperature T;

amplifying the contrast signal by a gain G(T) which is a function of the ambient temperature, so as to generate an amplified contrast signal (C(T)*G(T)), wherein ($C_p$(T)*G(T)) signifies the peak value of said amplified contrast signal;

generating a threshold Th(T) which is a function of the ambient temperature, wherein the gain G(T) and threshold Th(T) are defined to generate an "alarm trigger condition" in which the absolute value of the peak value of the amplified contrast signal ($C_p$(T)*G(T)) essentially exceeds the absolute value of said threshold Th(T), by substantially a constant value, over an ambient temperature range which extends between a first value below, and a second value above an intruder temperature level; and activating an alarm signal when said alarm trigger condition is encountered.

BRIEF DESCRIPTION OF THE DRAWINGS

For a better understanding, the invention will now be described by way of example only, with reference to the accompanying drawings, in which.

DETAILED DESCRIPTION OF PREFERRED EMBODIMENTS

Figure 2:
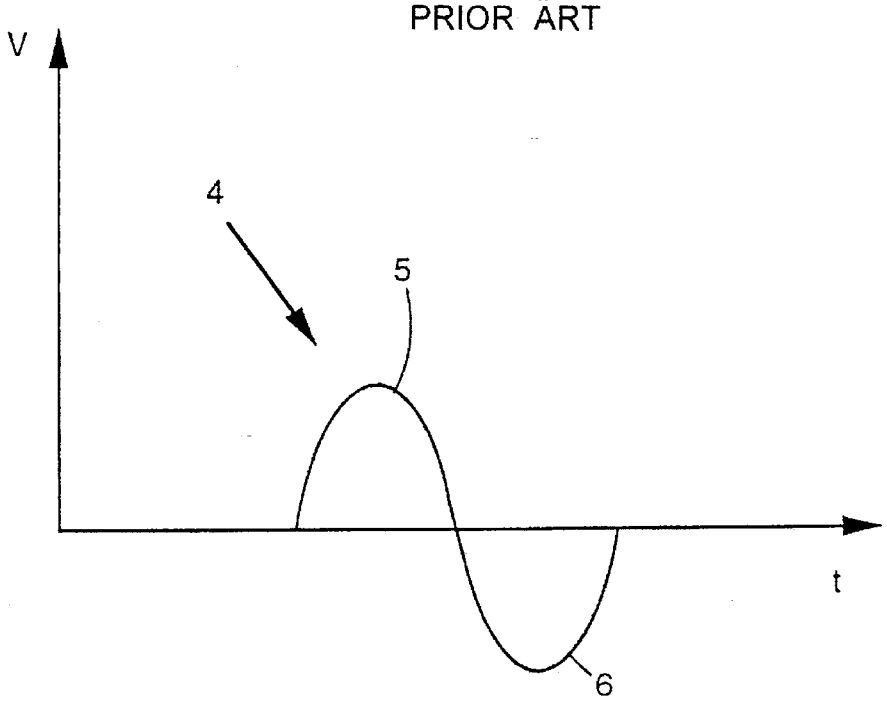
Fig. 2 PRIOR ART
FIG. 2 is a graph exemplifying an approximation of a typical contrast signal at a given fixed ambient temperature and at a specified distance from an intruder, as generated by the PIR sensor element of FIG. 1.
Figure 1:
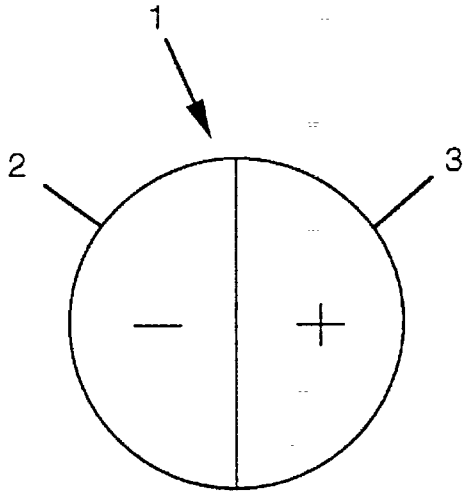
FIG. 1 is schematic illustration of a typical dual pyro-electric PIR sensor element.

Attention is first directed to FIG. 1 showing a schematic illustration of a typical dual pyro-electric PIR sensor element such as the LHi958 model, commercially available by Helmann, or other suitable sensing elements as known, per se, in the art. PIR Sensor 1 consists of a housing (not shown) which accommodates a negative sensing segment 2 and a positive sensing segment 3. An infra-red lens assembly (not shown), which consists of one or more adjacent lenses, forms a window in said housing, such that when the PIR sensor 1 is fitted in a protected area, each lens covers a given, typically non-overlapping, Field Of View (FOV). Upon intrusion, when an intruder crosses the FOV of a given lens at a specified distance from the PIR sensor 1, the latter will generate an alternating contrast signal 4, of the kind shown in FIG. 2, wherein signal portion 5 originates from the positive segment 3 and signal portion 6 originates from the negative segment 2 of PIR sensor 1. It is to be understood that FIG. 2 depicts only one cycle of the contrast signal which was generated upon crossing the FOV of one lens, and likewise, an identical cycle would be generated as the intruder crosses FOV associated with another lens in said lens assembly.

Figure 3:
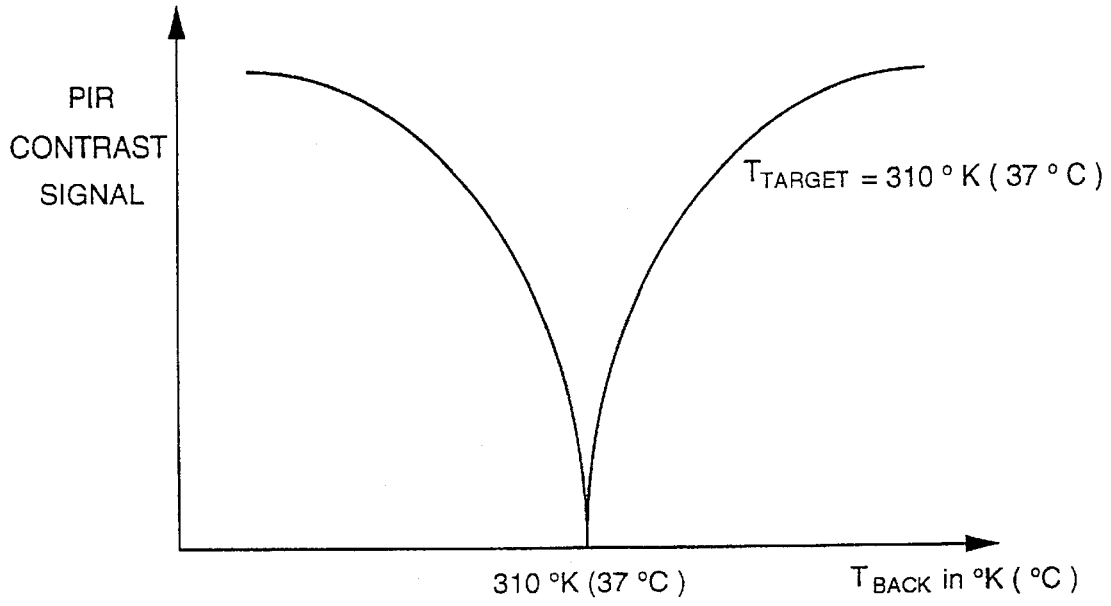
FIG. 3 is a graph exemplifying the contrast signal amplitude variations as a function of the ambient temperature, in accordance with Stephan-Boltzman's law.

Attention is now directed to FIG. 3 illustrating the contrast signal amplitude variations, as a function of the ambient temperature, in accordance with Stephan-Boltzman's law. As shown, the amplitude level increases as the absolute value of the difference between the intruder and ambient temperature increases. In fact, the PIR sensor 1 generates a contrast signal amplitude which obeys the following algorithmic expression (being a simplified approximation of Stephan-Boltzman's Law):

$$\text{PIR contrast signal} \propto |T^4_{TARGET} - T^4_{BACK}| \quad (2)$$

where $T_{TARGET}$ is the absolute temperature of the intruder or target, and $T_{BACK}$ is the absolute background temperature, all at a given intrusion speed and distance. Thus, as seen in FIG. 3, the contrast signal level is zero when $T_{TARGET}$ is equal to $T_{BACK}$. Accordingly, the absolute value of the amplitude of the contrast signal 4 matches the appropriate ordinate value as retrieved from the graph depicted in FIG. 3, which in turn is determined depending upon the prevailing ambient temperature at the protected area.

Figure 4:
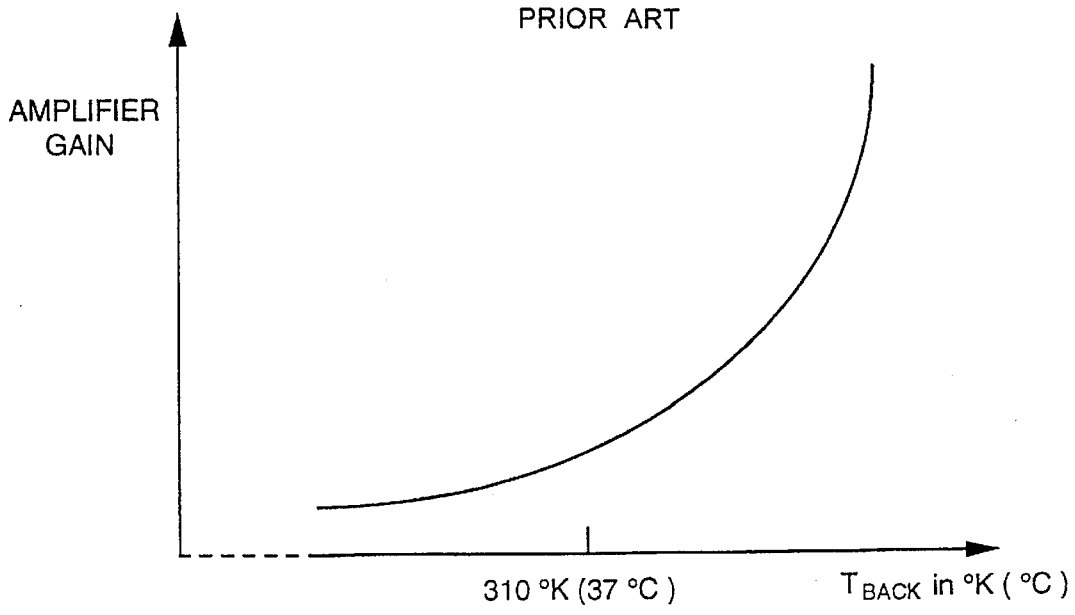
FIG. 4 is a graph exemplifying amplifier gain as a function of temperature in prior art ambient temperature compensating PIR intrusion detection systems.

FIG. 4 illustrates a graph exemplifying amplifier gain as a function of temperature in prior art ambient temperature compensating PIR intrusion detection systems. As shown by FIG. 4, the prior art amplifier gain is a monotonically increasing curve. The sensitivity or detection range of such a prior art detector (sensitivity being proportional to the amplifier gain as derived from the amplification gain function of FIG. 4 multiplied by the contrast signal as derived from the contrast signal shown in FIG. 1, for an invariant threshold level) is substantially constant as the ambient temperature approaches the target temperature from temperatures below the target temperature, but continuously increases when the background temperature exceeds the target temperature. In other words, the amplification gain function according to the prior art essentially duly compensates for the drop in contrast signal amplitude over the ambient temperature range extending below the target temperature. It fails, however, to accomplish similar compensating effect for contrast signal amplitude increase over ambient temperature range extending from above the target temperature, thereby enhancing the possibility for spurious alarm signals.

The environmental conditions where the ambient temperature is particularly prone to surpass a person's normal body temperature include hot equatorial climates, desert climates, and for example, manufacturing facilities dealing with heat processes such as food processing plants.

Figure 5:
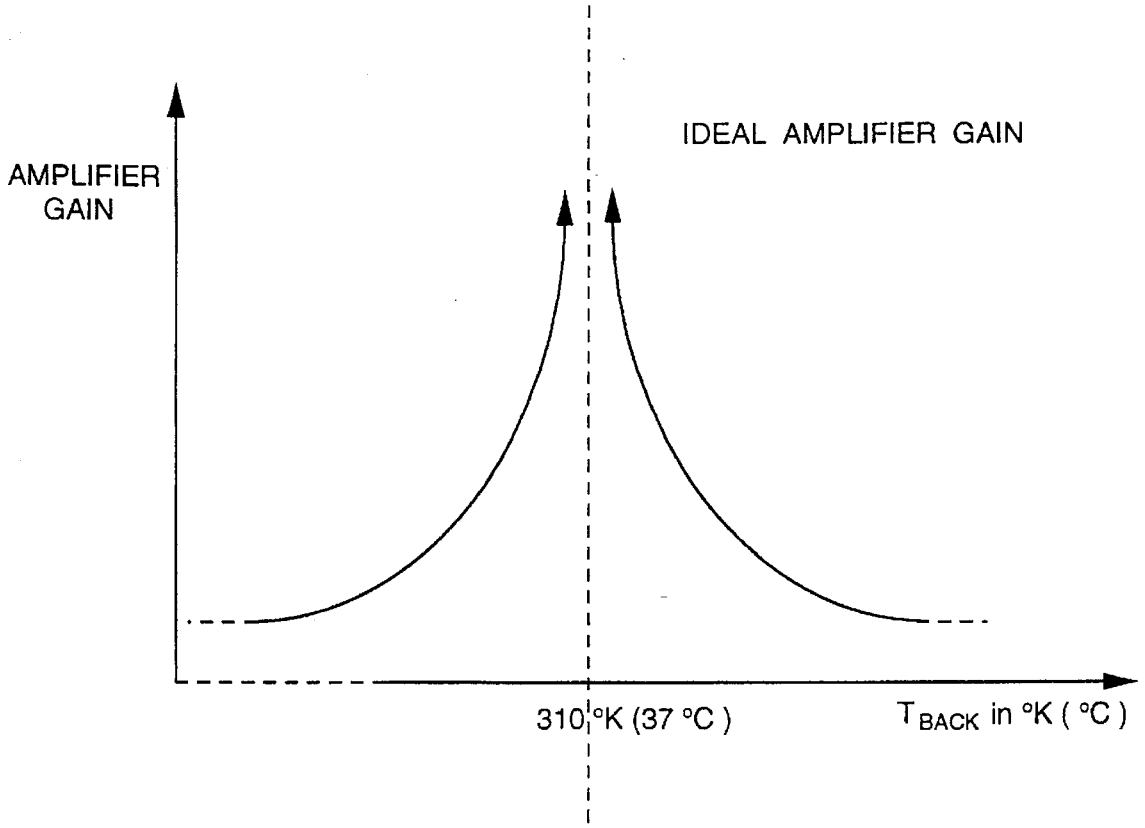
FIG. 5 is a graph exemplifying ideal amplifier gain as a function of ambient temperature in a preferred embodiment of the present invention.
Figure 6:
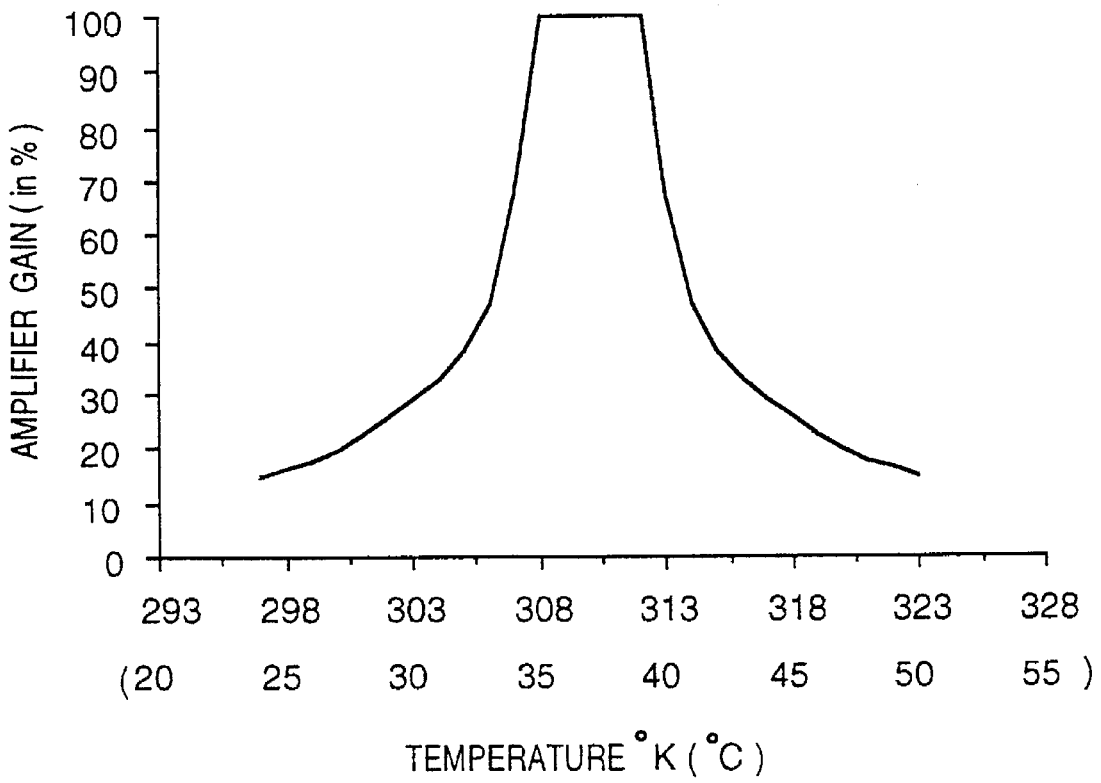
FIG. 6 is a graph exemplifying real, calibrated amplifier gain as a function of ambient temperature in preferred embodiments of the present invention.

By one embodiment, the present invention seeks to apply an ideal amplifier gain function to a PIR detector, as illustrated in FIG. 5, for an invariant threshold. The ideal amplifier gain function is a function inverse to the aforementioned approximation of Stephan-Boltzman's Law. With this ideal amplifier gain function, having an infinite gain when $T_{TARGET}=T_{BACK}$, a true uniform sensitivity detector is possible, irrespective of target temperature and whether it is above or below the ambient temperature. By so doing the drawback associated with the prior art device is coped with, in particular in the case where the ambient temperature exceeds the intruder temperature. Thus, in accordance with the system of the invention, for a relatively large contrast signal, generated responsive to an ambient temperature which surpasses the intruder body temperature, an appropriate low amplification gain is selected, rather than a large amplification gain as is the case in the prior art device, (which LIE specified has an increased vulnerability to spurious alarms). Of course, the infinite value of the amplifier gain function, when $T_{TARGET}=T_{BACK}$ may render the device vulnerable to spurious alarms, and accordingly, the amplifier gain is limited to a maximum value throughout a specified ambient temperature range, as illustrated in FIG. 6 which depicts one example of an amplifier gain function calibrated for a specific ambient temperature sensing element. In this particular embodiment the absolute value of the threshold level Th (designated, occasioaally, for sake of generality as Th(T)), is taken to be an essentially constant value below the absolute value of the product $C_p(T)*G(T)$ (standing for the peak value of the amplified contrast signal), over an ambient temperature range extending between first value below, and second value above the intruder temperature level, e.g. temperature range extending from 0 to 55 degrees Celsius and intruder temperature level of 37 degrees Celsius.

As will be explained in detail below, in an equivalent embodiment a constant amplification gain and a corresponding variable threshold are used.

Figure 7:
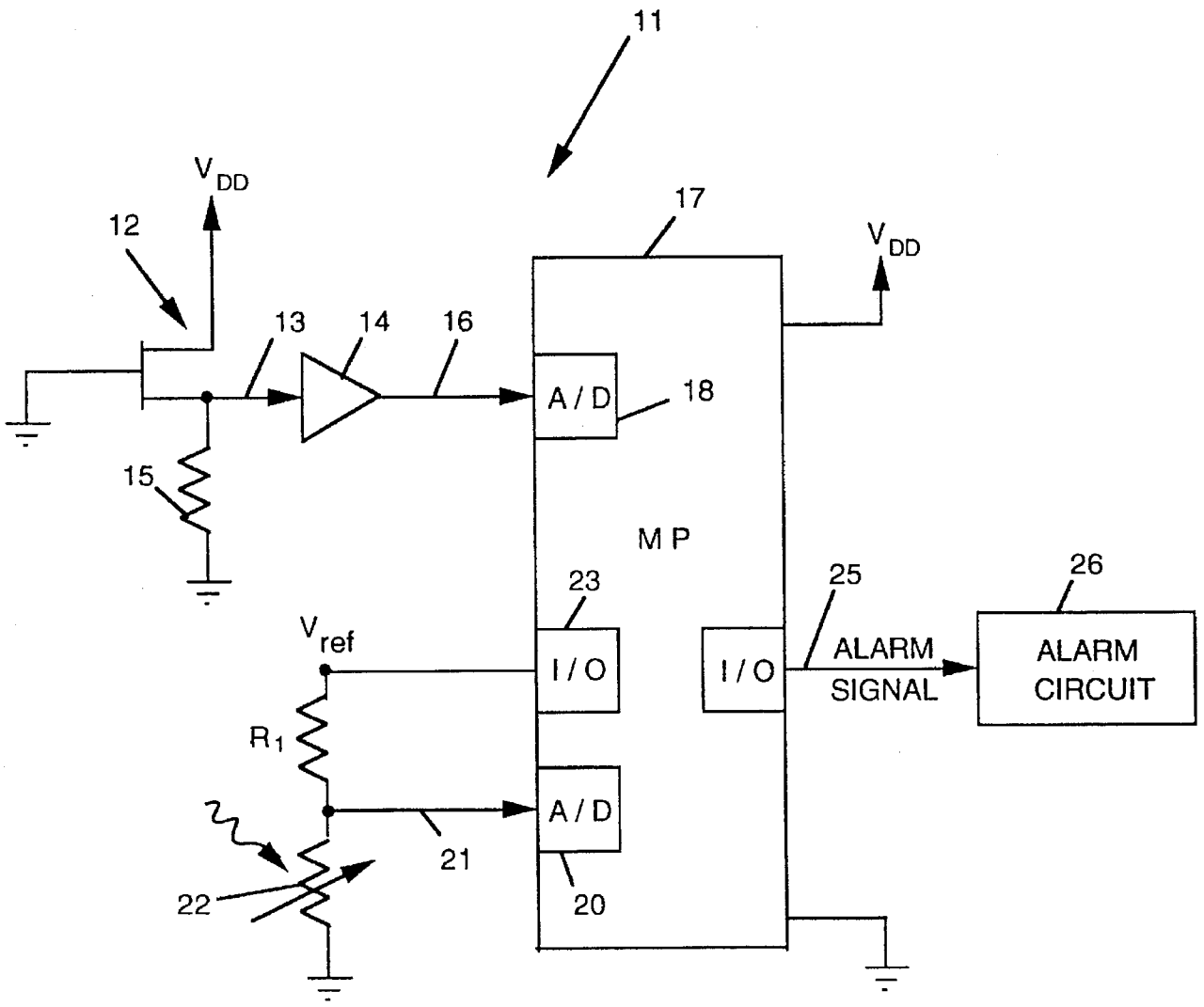
FIG. 7 is a circuit diagram, partly in block form, of one embodiment of a passive infrared intrusion detector having a variable threshold in accordance with the present invention.

Turning now to FIG. 7, there is shown a circuit diagram, partly in block form of a PIR intrusion detector 11 in accordance with the variable threshold embodiment of the invention. A suitable PIR sensing element 12 (e.g., the LHi958 model, commercially available by Helmann) biased by a resistor 15, or alternatively a similarly biased suitable thermopile or pyroelectric device, receives radiation from a region to be protected through a lens or mirror system (not shown) as known per se in the art. The output of the PIR sensing element 12 is a radiation contrast signal 13, such as the one shown in FIG. 2 above. The contrast signal 13 is fed to an amplifier 14 which amplifies the contrast signal 13 by a fixed gain function G (referred to, occasionally, for sake of generality as G(T)), being by this particular embodiment a constant value regardless of the ambient temperature T. The amplified contrast signal 16 is then fed to an analog-to-digital unit, e.g. A/D port 18 of microprocessor 17 (such as the ST6 model commercially available from SGS Thompson).

In addition to receiving the amplified contrast signal 16, the microprocessor 17 also receives, through a second A/D port 20, a signal 21 indicative of the ambient temperature. The ambient temperature signal 21 is derived from a voltage divider network comprised of a bias resistor $R_1$ in series with an ambient temperature sensor, such as Negative Temperature Coefficient (NTC) thermistor 22, whose sensitivity changes in a predetermined manner with respect to the ambient temperature, i.e. exponentially decreases, or such as Positive Temperature Coefficient (PTC) thermistor whose sensitivity exponentially increases with respect to ambient temperature. Thus, the voltage drop across the thermistor leg of the network varies as a function of the ambient temperature, i.e. in the case of NTC thermistor, ambient temperature increase entails decrease in the electrical resistance of the thermistor 22 which in turn imposes corresponding decrease in the voltage drop across the thermistor leg. This voltage level is fed to the microprocessor 17 as the ambient temperature signal 21.

The voltage divider network is powered by a voltage source $V_{ref}$ which is preferably derived from an output port 23 of the microprocessor 17. By deriving $V_{ref}$ from output port 23 of the microprocessor 17, it is possible to control the application of the voltage potential $V_{ref}$ to the voltage divider network thereby conserving power consumption of the detector 12. Such power conservation is particularly useful for battery powered detectors. Alternatively, $V_{ref}$ may be directly derived from a voltage source as $V_{DD}$, the detector system voltage source. If desired the bias resistor R1 may be substituted for equivalent biasing means, e.g. known per-se current source transistor.

The microprocessor 17 implements a computer program that compares the amplified contrast signal 16 to a variable threshold value dependent upon the value of the ambient temperature. In fact, owing to the constant gain function G, the threshold function Th(T) is proportional to the contrast signal amplitude as depicted in FIG. 3. In any case, the absolute value of the signal ($C_p$(T)*G) essentially exceeds the absolute value of the threshold Th(T) over an ambient temperature range which extends between first value below and second value above an intruder temperature level in other words, the threshold function Th(T) essentially complies with the following algorithmic expression:

$$C_p(T)*G(T)-Th(T)=K \text{ (for any } T) \quad (3)$$

Where $C_p$(T) stands for the peak value of C(T). The value of K, whilst being substantially constant, may vary from one application to the other as may be required and appropriate. The ambient temperature T may be calculated from the voltage level of the ambient temperature signal 21 on the basis of known physical laws relating voltage and resistance, and further knowing the dependence of the thermistor resistance on ambient temperature. When the value of the amplified contrast signal 16 reaches or surpasses the threshold value, the computer program generates an alarm signal 25 to trigger an alarm circuit 26.

Typically, the threshold value is set at a specified and selected temperature that prevails in the manufacturing plant, so as to initialize the system and thereafter, a variable threshold value is employed so that, at 35° C. for instance, the threshold value is approximately 20% of what the threshold value is at 25° C. Thus, the sensitivity of the detector 11 illustrated in FIG. 7 is functionally equivalent to a detector wherein a contrast signal is variably amplified in accordance with the amplifier gain function, such as illustrated for example in FIG. 6, and compared to a constant threshold value.

Figure 8:
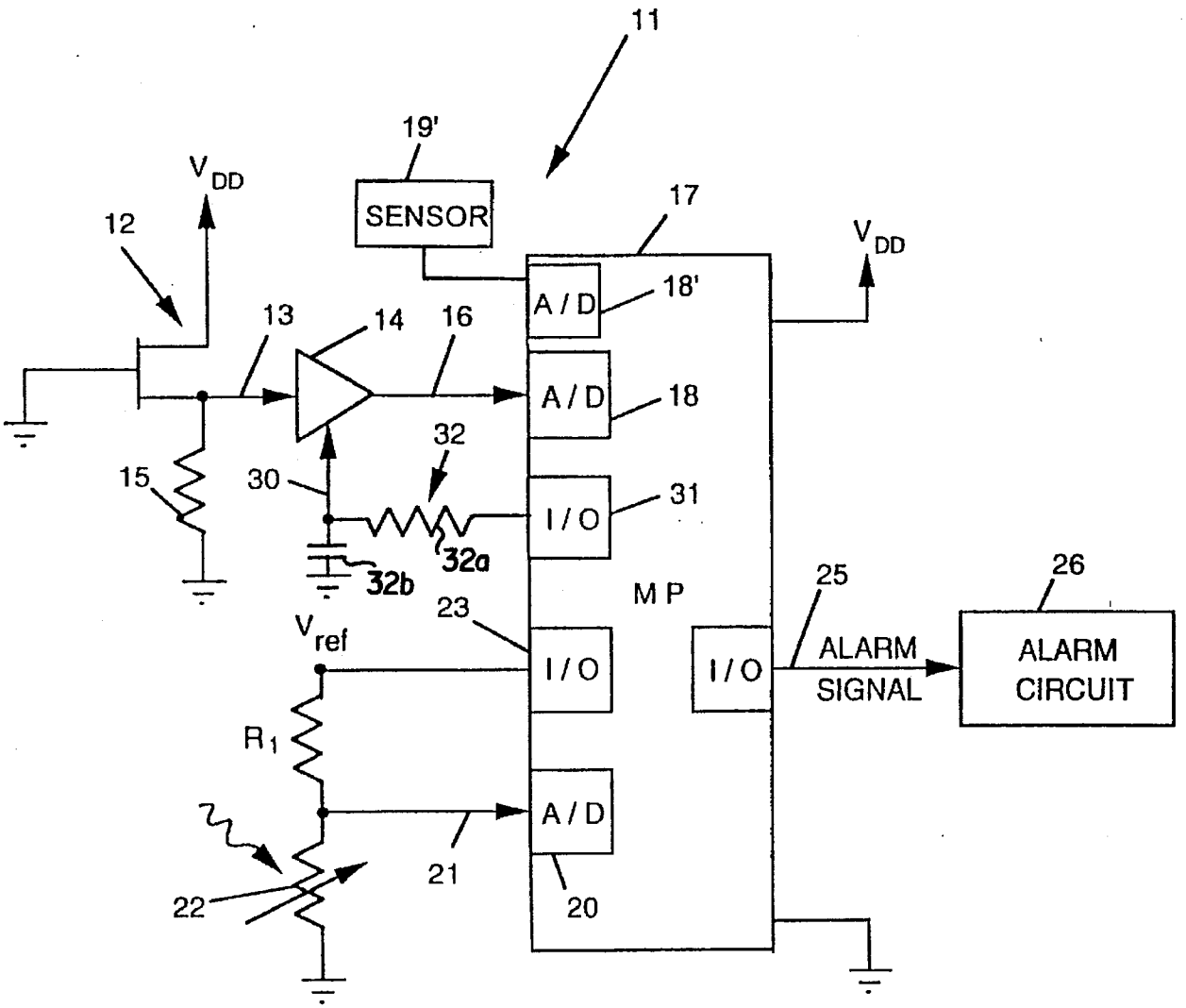
FIG. 8 is a circuit diagram, partly in block form, of a second embodiment of a passive infrared intrusion detector, having an amplifier gain function as in FIG. 6, in accordance with the present invention.

FIG. 8 illustrates this latter embodiment wherein the amplifier 14 has a variable amplification factor adjustable through a gain control line 30 which is connected to I/O port 31 of microprocessor 17 by the intermediary of resistor 32*a* and capacitor 32*b* forming RC circuit 32. I/O port 31 is set by a computer program executed by the microprocessor 17 in accordance with the amplifier gain function, such as illustrated for example in FIG. 6. The embodiment illustrated in FIG. 7, however, is slightly less expensive to manufacture than the embodiment illustrated in FIG. 8 as a less complicated amplifier is required in the former embodiment.

Thus, port 31 delivers as an output a digital signal, and accordingly it is required to convert it into analogue form for accomplishing an amplification gain as depected, for example. in FIG. 6. A typical, yet not exclusive, manner for obtaining the same may be by implementing a so called "Pulse Width Modulator" (PWM) circuitry where the modulated digital signal is produced at the output of port 31 and has a predetermined frequency and variable duty cycle. The modulated signal is fed to the RC circuit 32 charging the capacitor 32*b* in the case of "1" at the output of port 31 and discharging it in case of "0". Obviously the rate or charge\discharge is dependent upon the time constant of the RC circuit 32. The values of the capacitor 32*b* and resistor 32*a* are a priori determined and, in conjunction with appropriate digital signal modulation (adjustable by said computer program), the desired amplification gain is achieved.

Regardless of whether the embodiment of FIG. 7 or FIG. 8 is concerned it is desired to determine the ambient temperature as accurately as possible in order to accurately apply the aforementioned amplifier gain curve to the prevailing environmental conditions. The resistance of an NTC thermistor generally follows the relationship of:

$$R_{T(°C.)} = R_{25°C.}\exp\left[B*\left(\frac{1}{T(°C.)+273}-\frac{1}{273+25}\right)\right] \quad (4)$$

where $R_{T(°C.)}$ is the resistance at a given temperature on the Celsius scale, $R_{25°\,C.}$ is a resistance constant measured at 25° C., and B is an additional (negative) temperature coefficient. The tolerance of a thermistor is typically approximately ±10% from the manufacturer's stated resistance per degree of temperature figure, and for the most part, deviations from the stated figure are due to inaccuracies in determining the value of $R_{25°\,C.}$. In the preferred embodiments of the present invention, the detector 11 is manufactured by accurately measuring, preferably at 25° C., the resistance constant $R_{25°\,C.}$, comparing the measured value to an ideal $R_{25°\,C.}$ value as retrieved from the manufacturer technical specification documentation, and in the case of discrepancy, determining an appropriate compensation factor which is incorporated in the portion of the aforementioned algorithm responsible for determining the ambient temperature. In this manner, the amplifier gain function illustrated in FIG. 6 may be more accurately applied to the real prevailing, environmental conditions.

If desired, the microprocessor 17 may be programmed to modulate both the amplification gain factor and the threshold level, so as to obtain functional equivalence to either of the embodiments that were described with reference to FIGS. 7 and 8. By this embodiment the determination of the gain function G(T) and threshold function Th(T) is governed by the above referred to algorithmic expression 3.

Optionally, additional sensors e.g., sensor (19' couple to A/D port 18' in FIG. 8) may be employed, in which case the microprocessor 17 will activate an alarm signal if the "alarm trigger condition" is encountered in one or more of the employed sensors. If desired, and for attaining intrusion detection with improved degree of certainty, an alarm signal is triggered only if the "alarm trigger condition" is encountered with respect to each one of the employed sensors.

The type of the additional sensors 19' should not necessarily be confined to a PIR sensor element, and accordingly ultra-sound and/or microwave sensors may also be utilized.

The invention has been described with a certain degree of particularity but it should be understood that various alterations and modifications may be made without departing from the spirit or scope of the invention as hereinafter claimed.

We claim:

1. A system for detecting intrusion into a protected area by virtue of a change in detected infrared energy from an ambient level, and generating an alarm signal in response thereto, comprising:

a first assembly including a Passive Infrared (PIR) sensing element for generating a contrast signal C(T) representative of a deviation in detected infrared energy from that corresponding to the ambient temperature, wherein $C_p$(T) signifies the peak value of said contrast signal;

a second assembly for generating an ambient temperature signal representative of the ambient temperature T;

an amplifier for amplifying the contrast signal by a gain G(T) which is a function of the ambient temperature, so as to generate an amplified contrast signal (C(T)*G(T)), wherein ($C_p$(T)*G*(T)) signifies the peak value of said amplified contrast signal;

a processor coupled to said second assembly and to said amplifier, which processor is adapted to generate a threshold Th(T) which is a function of the ambient temperature, said gain G(T) and threshold Th(T) being selectively varied so as to define an "alarm trigger condition" signal in which the absolute value of the peak value of the amplified contrast signal ($C_p$(T)*G(T)) exceeds the absolute value of said threshold Th(T) by substantially a constant value over an ambient temperature range which extends between a first value below an intruder temperature level and a second value above the intruder temperature level; and an alarm activator in association with said processor for activating an alarm signal when said alarm trigger condition signal is encountered.

2. A system according to claim 1 wherein said threshold Th(T) is held substantially invariant over said ambient temperature range.

3. A system according to claim 2 wherein said processor is adapted to employ as the gain G(T) the function:

$$\frac{1}{|\epsilon_T T_{TARGET}^4 - \epsilon_B T_{BACK}^4|}$$

where $T_{TARGET}$ is the absolute temperature of the target, and $T_{BACK}$ is the absolute ambient temperature; $\epsilon_T$ is the Emissivity coefficient of the target and $\epsilon_B$ is the Emissivity coefficient of the background, both being essentially equal to 1.

4. A system according to claim 1 wherein said gain G(T) is held substantially invariant over said ambient temperature range.

5. A system according to claim 1 wherein said second assembly includes a voltage divider network having, in one leg thereof, an element whose resistance varies depending upon the ambient temperature.

6. A system according to claim 5 wherein an output line of the processor provide a reference voltage to said voltage divider network, thereby enabling power consumption by the voltage divider network to be controlled.

7. A system according to claim 6 wherein a resistance constant of the variably resistive element is measured and compared to a predetermined ideal value so as to determine a compensation factor, thereby providing an accurate application of the gain to prevailing environmental conditions.

8. A system according to claim 7 wherein the variably resistive element comprises is a thermistor.

9. A system according to claim 1 wherein the intruder temperature level is about 37 degrees Celsius.

10. A method for detecting intrusion into a protected area by virtue of a change in detected infrared energy from an ambient level and generating an alarm signal in response thereto, comprising the steps of:

generating a contrast signal C(T) representative of a deviation in detected infrared energy from that corresponding to the ambient temperature, wherein $C_p$(T) signifies the peak value of said contrast signal;

generating an ambient temperature signal representative of the ambient temperature T;

amplifying the contrast signal by a gain G(T) which is a function of the ambient temperature, so as to generate an amplified contrast signal (C(T)*G(T)), wherein ($C_p$(T)*G(T)) signifies the peak value of said amplified contrast signal;

generating a threshold Th(T) which is a function of the ambient temperature, said gain G(T) and threshold Th(T) being selectively varied so as to define an "alarm trigger condition" signal in which the absolute value of the peak value of the amplified contrast signal ($C_p$(T)*G(T)) exceeds the absolute value of said threshold Th(T) by substantially a constant value over an ambient temperature range which extends between a first value below an intruder temperature level and a second value above the intruder temperature level; and activating an alarm signal when said alarm trigger condition signal is encountered.

11. A method according to claim 10 wherein said threshold Th(T) is held substantially invariant over said ambient temperature range.

12. A method according to claim 11 further comprising the step of providing a processor adapted to employ, as the gain G(T), the function:

$$\frac{1}{|\epsilon_T T_{TARGET}^4 - \epsilon_B T_{BACK}^4|}$$

where $T_{TARGET}$ is the absolute temperature of the target, $T_{BACK}$ is the absolute ambient temperature, $\epsilon_T$ is the Emissivity coefficient of the target, and $\epsilon_B$ is the Emissivity coefficient of the background, and wherein both $\epsilon_T$ and $\epsilon_B$ are essentially equal to 1.

13. A method according to claim 10 wherein said gain G(T) is held substantially invariant over said ambient temperature range.

14. A method according to claim 10 wherein the intruder temperature level is about 37 degrees Celsius.

15. A system for detecting intrusion into a protected area and for generating an alarm signal in response thereto, comprising:

(i) at least one first sensor, each including a respective PIR sensing element for generating a respective contrast signal C(T) representative of a deviation in detected infrared energy from that corresponding to the ambient temperature T, wherein $C_p$(T) signifies the peak value of said respective contrast signal, and a respective amplifier for amplifying the respective contrast signal by a respective gain G(T) which is a function of the ambient temperature, so as to generate a respective amplified contrast signal (C(T)*G(T)), wherein ($C_p$(T)*G(T)) signifies the peak value of said respective amplified contrast signal;

(ii) at least one second sensor, each comprising means for generating a respective second "alarm trigger condition" signal responsive to the detection of intrusion into the protected area;

(iii) an ambient temperature generation assembly for generating an ambient temperature signal representative of said ambient temperature T;

(iv) a processor coupled to said ambient temperature generation assembly and to said first and second sensors, the processor being adapted to generate, with respect to each one of said first sensors, a respective threshold Th(T) which is a function of the ambient temperature, said respective gain G(T) and said respective threshold Th(T) associated with each one of said first sensors being selectively varied so as to generate a respective first "alarm trigger condition" signal in which the absolute value of the peak value of the respective amplified contrast signal ($C_p(T)*G(T)$) exceeds the absolute value of said respective threshold Th(T) by substantially a respective constant value over an ambient temperature range which extends between a respective first value below an intruder temperature level and a respective second value above the intruder temperature level, wherein said processor is responsive to the respective first and second alarm trigger condition signals for producing an alarm activation signal; and (v) an alarm activator in association with said processor and responsive to said alarm activation signal for activating an alarm signal.

16. A system according to claim 15, wherein said at least one second sensor comprises a PIR sensor.

17. A system according to claim 15, wherein said at least one second sensor comprises an ultra-sound sensor.

18. A system according to claim 15, wherein said at least one second sensor comprises a microwave sensor.

* * * * *

UNITED STATES PATENT AND TRADEMARK OFFICE

CERTIFICATE OF CORRECTION

PATENT NO. : 5,629,676

DATED : May 13, 1997

INVENTOR(S) : Kartoun et al.

It is certified that error appears in the above-indentified patent and that said Letters Patent is hereby corrected as shown below:

Col. 1, line 42, after sensitivity please delete ",".

Col. 2, line 65, after provided, please insert --,--.

Col. 3, line 6, after (T) please delete ",".

Col. 3, line 36, after embodiment please insert ",".

Col. 4, line 50, after (not shown) please insert ",".

Col. 8, line 34, please delete "couple" and replace with --coupled--.

UNITED STATES PATENT AND TRADEMARK OFFICE

CERTIFICATE OF CORRECTION

PATENT NO. : 5,629,676 Page 2 of 2

DATED : May 13, 1997

INVENTOR(S) : Kartoun et al.

It is certified that error appears in the above-indentified patent and that said Letters Patent is hereby corrected as shown below:

Col. 10, line 21, please replace the equation below $$\frac{1}{|\epsilon_T T^4_{TARGET} - \epsilon_B T^4_{BACK}|}$$

with the following equation:

$$\frac{1}{|\epsilon_T T_{TARGET} 4 - \epsilon_B T_{BACK} 4|}$$

Signed and Sealed this

Eighteenth Day of November 1997

*Attest:*

Bruce Lehman

BRUCE LEHMAN

*Attesting Officer*

*Commissioner of Patents and Trademarks*